US009368877B2

(12) United States Patent
Ilnar et al.

(10) Patent No.: US 9,368,877 B2
(45) Date of Patent: Jun. 14, 2016

(54) MULTI-ARRAY ANTENNA

(71) Applicant: ACE TECHNOLOGIES CORPORATION, Incheon (KR)

(72) Inventors: Battarov Ilnar, Incheon (KR); Jae-Hoon Tae, Incheon (KR); Min-Seok Jung, Gyeonggi-Do (KR); Seung-Cheol Lee, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 244 days.

(21) Appl. No.: 14/012,138

(22) Filed: Aug. 28, 2013

(65) Prior Publication Data

US 2014/0184464 A1 Jul. 3, 2014

Related U.S. Application Data

(63) Continuation of application No. PCT/KR2012/001469, filed on Feb. 27, 2012.

(30) Foreign Application Priority Data

Feb. 28, 2011 (KR) ..... 10-2011-0018247

(51) Int. Cl.
*H01Q 19/10* (2006.01)
*H01Q 21/26* (2006.01)
(Continued)

(52) U.S. Cl.
CPC ..... *H01Q 19/10* (2013.01); *H01Q 5/42* (2015.01); *H01Q 15/14* (2013.01); *H01Q 21/26* (2013.01); *H01Q 25/00* (2013.01)

(58) Field of Classification Search
CPC ..... H01Q 19/10; H01Q 21/26; H01Q 15/14; H01Q 25/00; H01Q 5/42
USPC ..... 343/756, 835, 853, 912
See application file for complete search history.

(56) References Cited

U.S. PATENT DOCUMENTS 4,203,118 A * 5/1980 Alford ..... H01Q 21/20 343/727
5,710,569 A * 1/1998 Oh ..... H01Q 19/108 343/816

(Continued)

FOREIGN PATENT DOCUMENTS

JP 28-46609 B2 1/1999
KR 10-2008-0029199 A 4/2008

(Continued)

*Primary Examiner* — Tho G Phan
(74) *Attorney, Agent, or Firm* — Mintz Levin Cohn Ferris Glovsky and Popeo, P.C.; Kongsik Kim; Jonathon Western

(57) ABSTRACT

A multi-array antenna having superior electrical properties is disclosed. The multi-array antenna includes a reflector plate; first radiators arranged over a surface of the reflector plate and configured to form a first beam; and second radiators arranged over a surface of the reflector plate and configured to form a second beam. Here, one of the first radiators and one of the second radiators are arranged in an imaginary first line along a lengthwise direction of the reflector plate, another one of the first radiators and another one of the second radiators are arranged in an imaginary second line, the first radiator arranged in the first line and the first radiator arranged in the second line are positioned in a diagonal direction, and the second radiator arranged in the first line and the second radiator arranged in the second line are positioned in a diagonal direction.

9 Claims, 10 Drawing Sheets

(51) Int. Cl.

| | |
|---|---|
| ***H01Q 5/42*** | (2015.01) |
| ***H01Q 15/14*** | (2006.01) |
| ***H01Q 25/00*** | (2006.01) |

(56) References Cited

U.S. PATENT DOCUMENTS 8,199,063 B2 * 6/2012 Moon ..... H01Q 1/246 343/793
8,860,622 B2 * 10/2014 Shin ..... H01Q 19/021 343/815
2009/0015498 A1 * 1/2009 Deng ..... H01Q 1/246 343/757

FOREIGN PATENT DOCUMENTS

KR 10-2009-0035318 A 4/2009
KR 10-2010-0067645 A 6/2010

* cited by examiner (A)

(B)

MULTI-ARRAY ANTENNA

CROSS-REFERENCE TO RELATED APPLICATIONS

This application is a continuation of International Application No. PCT/KR2012/001469, filed on Feb. 27, 2012, which claims priority from Korean Patent Application No. 10-2011-0018247, filed on Feb. 28, 2011. The disclosures of the above patent applications are incorporated herein by reference in their entirety.

TECHNICAL FIELD

The present invention relates to a multi-array antenna that offers superior electrical properties.

BACKGROUND

In recent times, the MIMO antenna has been established as an important issue, and there is active research under way regarding the MIMO antenna.

Thus, there is a need for a multi-array antenna that generates multiple beam patterns. In particular, there is a need for a multi-array antenna that offers superior electrical properties while maintaining a small size.

SUMMARY

An aspect of the invention is to provide a multi-array antenna having superior electrical properties.

To achieve the objective above, an embodiment of the invention provides a multi-array antenna that includes a reflector plate; first radiators arranged over a surface of the reflector plate and configured to form a first beam; and second radiators arranged over a surface of the reflector plate and configured to form a second beam. Here, one of the first radiators and one of the second radiators are arranged in an imaginary first line along a lengthwise direction of the reflector plate, another one of the first radiators and another one of the second radiators are arranged in an imaginary second line, the first radiator arranged in the first line and the first radiator arranged in the second line are positioned in a diagonal direction, and the second radiator arranged in the first line and the second radiator arranged in the second line are positioned in a diagonal direction.

Another embodiment of the invention provides a multi-array antenna that includes a reflector plate; first radiators arranged over a surface of the reflector plate and configured to form a first beam; and second radiators arranged over a surface of the reflector plate and configured to form a second beam. Here, one of the first radiators and one of the second radiators form a first line along a lengthwise direction of the reflector plate, another one of the first radiators and another one of the second radiators form a second line, the first radiator arranged in the first line outputs a first radiation pattern in a direction opposite to the second line with respect to the first line, the first radiator arranged in the second line outputs a second radiation pattern in a direction opposite to the first line with respect to the second line, the second radiator arranged in the first line outputs a third radiation pattern in a direction opposite to the second line with respect to the first line, and the second radiator arranged in the second line outputs a fourth pattern in a direction opposite to the first line with respect to the second line.

Yet another embodiment of the invention provides a multi-array antenna that includes a reflector plate; first radiators arranged over a surface of the reflector plate and configured to form a first beam; and second radiators arranged over a surface of the reflector plate and configured to form a second beam. Here, one of the first radiators and one of the second radiators form a first line along a lengthwise direction of the reflector plate, another one of the first radiators and another one of the second radiators form a second line, a portion of the radiating members of the first radiator facing the second radiator has a smaller electrical length than does other portions of the radiating members, and a portion of the radiating members of the second radiator facing the first radiator has a smaller electrical length than does other portions of the radiating members of the second radiator.

A multi-array antenna according to an embodiment of the invention has first radiators and second radiators arranged mixedly in a first line and a second line, where the radiators are implemented such that the radiation patterns outputted from the radiators face outward directions. Thus, there are superior isolation properties obtained between the first radiators and second radiators, and the multi-array antenna can be implemented in a small size.

Also, in the multi-array antenna, the feed line may be capacitively coupled to the balun part rather than being connected directly. Thus, there is no need to apply plating on the radiators, and as a result, the time and cost for manufacturing the multi-array antenna can be reduced.

Furthermore, the radiators can be positioned only on an upper surface of the reflector plate, so that the portions for applying soldering can be considerably reduced. Thus, the time and cost for manufacturing the multi-array antenna can be reduced.

Additional aspects and advantages of the present invention will be set forth in part in the description which follows, and in part will be obvious from the description, or may be learned by practice of the invention.

DETAILED DESCRIPTION

Certain embodiments of the present invention will be described below in more detail with reference to the accompanying drawings.

Figure 1:
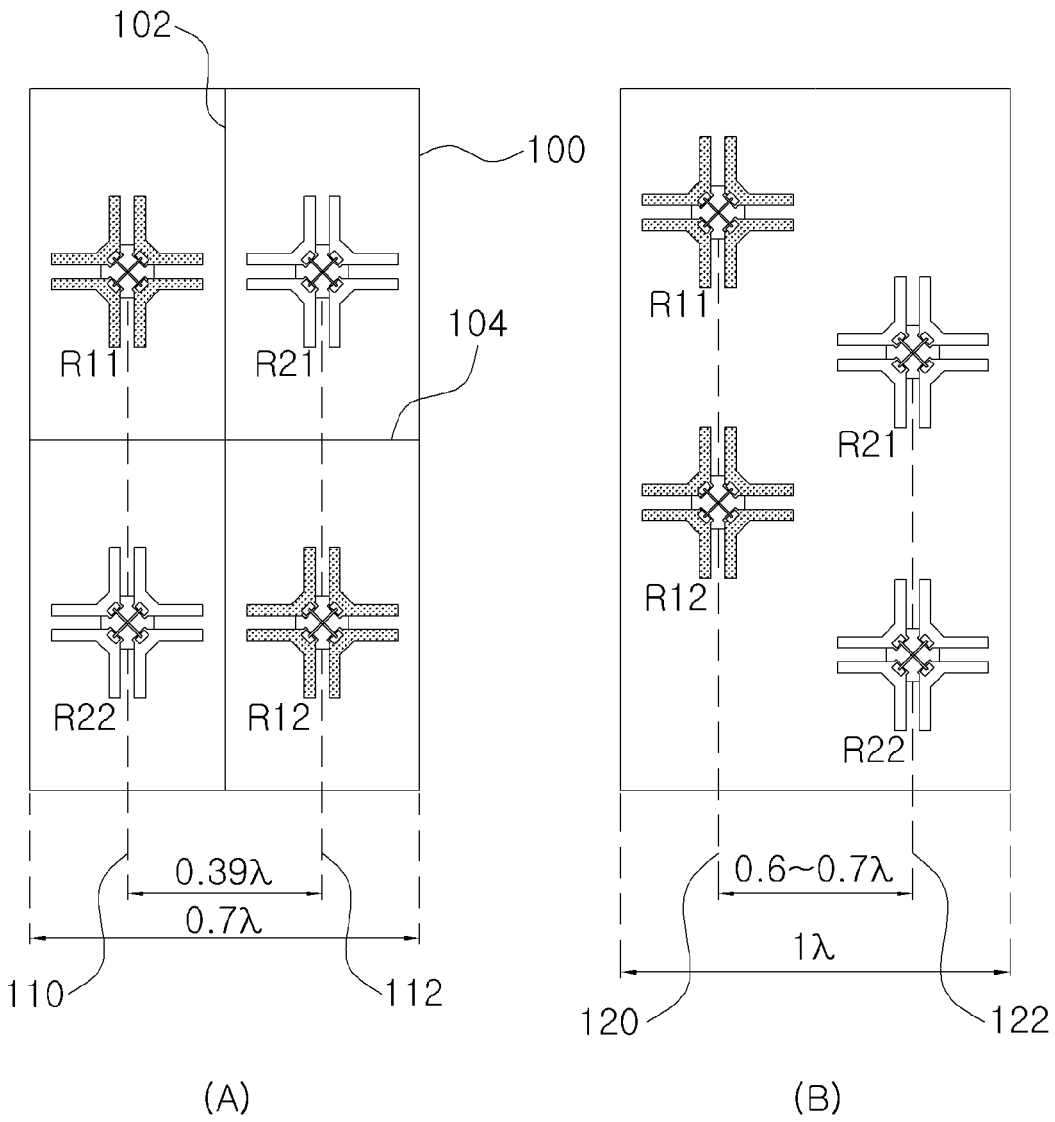
FIG. 1 is a diagram schematically illustrating a multi-array antenna according to a first embodiment of the invention.

FIG. 1 is a diagram schematically illustrating a multi-array antenna according to a first embodiment of the invention.

Referring to FIG. 1(A), the multi-array antenna of this embodiment can be, for example, a MIMO antenna used at a base station, and may include a reflector plate 100, first radiators R11 and R12, and second radiators R21 and R22.

The reflector plate 100 may be made of a conductor and may serve as a reflector and a ground.

The first radiators R11 and R12 may output a first beam pattern, while the second radiators R21 and R22 may output a second beam pattern. That is, the first radiators R11 and R12 can operate as an antenna, while the second radiators R21 and R22 can operate as another antenna.

According to an embodiment of the invention, the first radiator R11 and the second radiator R22 may be arranged in an imaginary first line 110 formed in a lengthwise direction of the reflector plate 100, while the first radiator R12 and the second radiator R21 may be arranged in an imaginary second line 112 formed in a lengthwise direction of the reflector plate 100. That is, the first radiators R11 and R12 may be positioned separately in the first line 110 and second line 112 instead of being arranged in the same line, and the second radiators R21 and R22 may also be positioned separately in the first line 110 and second line 112 instead of being arranged in the same line.

According to another embodiment of the invention, a first radiator and a second radiator can be arranged side by side along a lateral direction (the lateral direction in FIG. 1(A)) and facing each other. For example, the first radiator R11 may be arranged side by side with and facing the second radiator R21, and the first radiator R12 may be arranged side by side with and facing the second radiator R22. Also, the first radiators R11 and R12 can be arranged diagonally to each other, and the second radiators R21 and R22 can be arranged diagonally to each other.

With the multi-array antenna fabricated as above, the distance between the first radiator and the second radiator, i.e. the distance between the first line 110 and the second line 112, can be made 0.4λ or smaller, and the width of the reflector plate 100 can be made 0.7λ or smaller, as illustrated in FIG. 1(A). Here, λ represents the smallest wavelength from among a wavelength corresponding to the first radiators R11 and R12 and a wavelength corresponding to the second radiators R21 and R22.

In contrast, if the first radiators R11 and R12 are arranged in a first line 120 and the second radiators R21 and R22 are arranged in a second line 122 as illustrated in FIG. 1(B), then in order to prevent mutual coupling between the first radiators R11 and R12 and the second radiators R21 and R22, the distance between the first line 120 and the second line 122 may need to be a minimum of 0.6λ, and the width of the reflector plate 100 may need to be a minimum of 1λ. Also, the radiators may have to be arranged along the lengthwise direction of the reflector plate with greater distances in-between, as illustrated in FIG. 1(B).

In short, the multi-array antenna of this embodiment can have the first radiators R11 and R12 arranged in a diagonal direction to each other and the second radiators R21 and R22 arranged in a diagonal direction to each other, in order to minimize mutual coupling (interference) between the first radiators R11 and R12 and the second radiators R21 and R22. Consequently, the distance between the centers of a first radiator and a second radiator facing each other can be made to be 0.4λ or smaller, so that the size of the multi-array antenna can be reduced.

Such a multi-array antenna can implement a broad band or multiple bands and can implement, for example, the LTE800, GSM800, and GSM900 bands.

According to another embodiment of the invention, the multi-array antenna can further include a first choke member 102 that is arranged along the lengthwise direction of the reflector plate 100 between the first line 110 and second line 112, and a second choke member 104 arranged in a direction intersecting the first choke member 102.

A choke member 102 or 104 may be arranged between the radiators R11, R12, R21, and R22 to adjust the beam width or alter the beam direction. Here, the choke member 102 or 104 can be connected directly to the reflector plate 100 or can be arranged separated from the reflector plate 100, and a choke member 102 or 104 can have partially varying heights.

Figure 2:
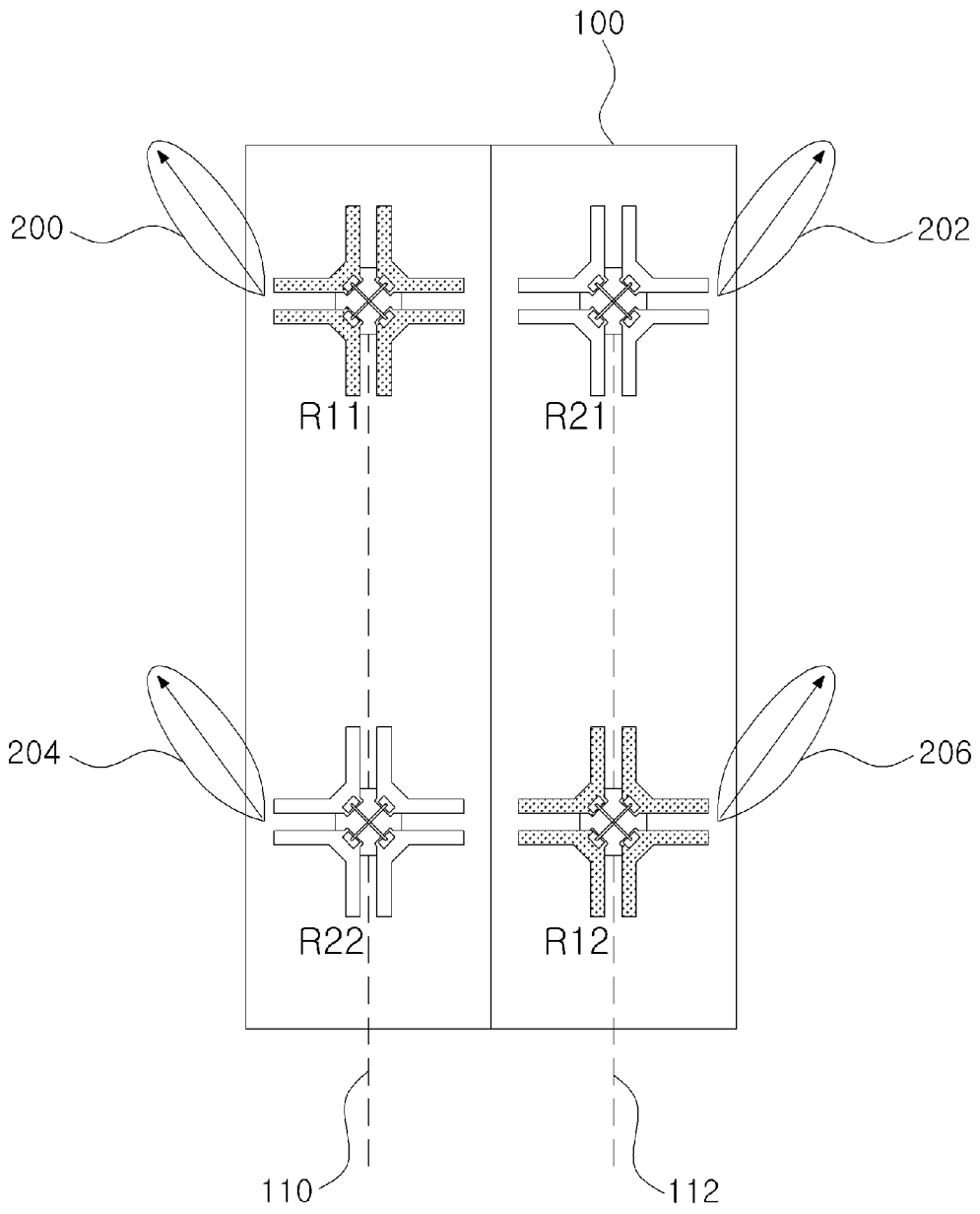
FIG. 2 is a diagram schematically illustrating a multi-array antenna according to a second embodiment of the invention.

FIG. 2 is a diagram schematically illustrating a multi-array antenna according to a second embodiment of the invention.

Referring to FIG. 2, a first radiator R11 and a second radiator R22 may be arranged in a first line 110, while a second radiator R21 and a first radiator R12 may be arranged in a second line 112.

The first radiator R11 may output a first radiation pattern 200 that radiates outward from the center of the reflector plate 100, and the second radiator R21 may output a second radiation pattern 202 that radiates outward from the center of the reflector plate 100. Since the first radiation pattern 200 and the second radiation pattern 202 are each formed in an outward direction of the reflector plate 100, as illustrated in FIG. 2, the mutual interference between the radiation patterns 200 and 202 can be minimized.

The second radiator R22 may output a third radiation pattern 204 that radiates outward from the center of the reflector plate 100, and the first radiator R12 may output a fourth radiation pattern 206 that radiates outward from the center of the reflector plate 100. Since the third radiation pattern 204 and the fourth radiation pattern 206 are each formed in an outward direction of the reflector plate 100, as illustrated in FIG. 2, the interference between the radiation patterns 204 and 206 can be minimized.

The radiation patterns 200 and 206 outputted from the first radiators R11 and R12 may form a first beam pattern, while the radiation patterns 202 and 204 outputted from the second radiators R21 and R22 may form a second beam pattern.

In short, in the multi-array antenna of this embodiment, a first radiator and a second radiator facing the first radiator have the radiation patterns oriented in opposite directions such that the radiation patterns do not overlap, and thus the radiation patterns are isolated as much as possible to minimize mutual interference.

Although it was not described above, the first radiators R11 and R12 can be connected to and fed from the same first power distributor, and the second radiators R21 and R22 can be connected to and fed from the same second power distributor. Of course, the amount of power fed to each of the first radiators R11 and R12 can be different, and the amount of power fed to each of the second radiators R21 and R22 can also be different. That is, the distribution of power to the radiators may be determined according to the desired beam pattern.

Figure 3:
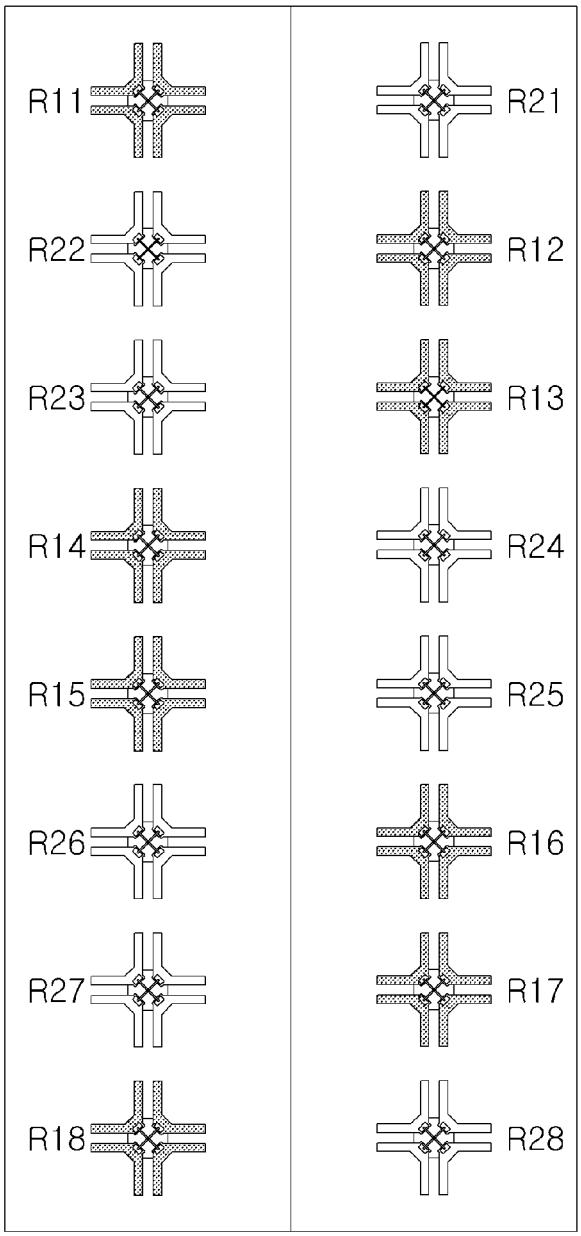
FIG. 3 and FIG. 4 are diagrams illustrating arrays of radiators according to an embodiment of the invention.
Figure 4:
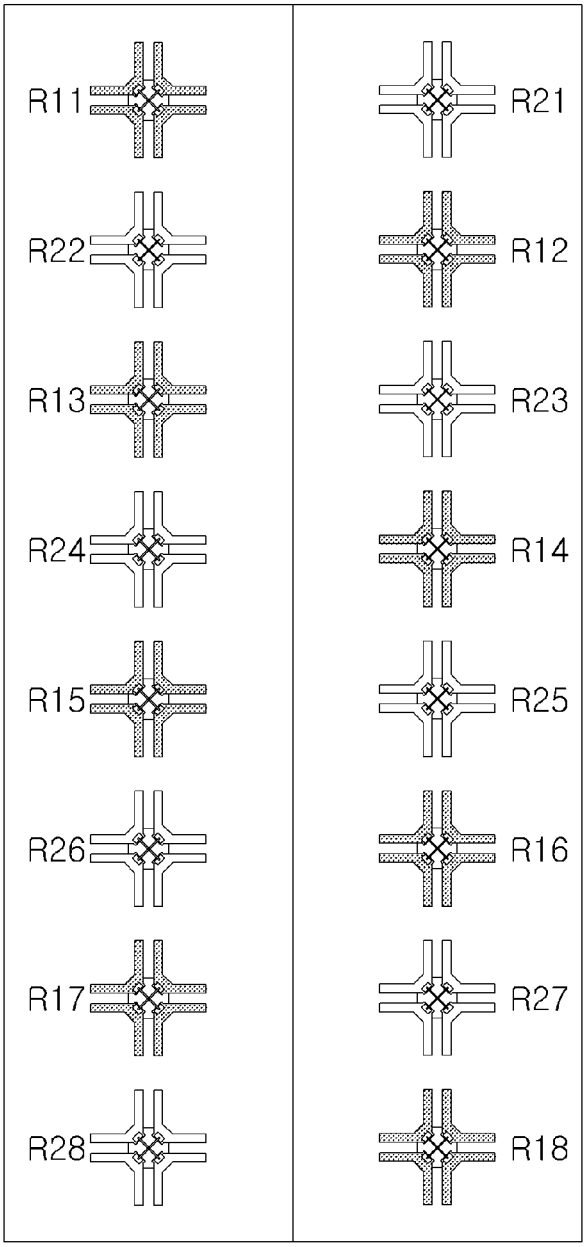

FIG. 3 and FIG. 4 are diagrams illustrating arrays of radiators according to an embodiment of the invention.

Referring to FIG. 3, the first radiators R11 to R18 and the second radiators R21 to R28 may be arranged uniformly separated in the first line and second line. In particular, except for the radiators R11 and R21, the first radiators R12 to R18 and second radiators R22 to R28, with two radiators forming a pair, can be arranged alternately in diagonal directions.

For example, the first radiators R11 and R12 can be arranged in a diagonal direction, the first radiators R12 and R13 can be arranged sequentially in the second line, and the first radiators R14 and R15 positioned sequentially can be arranged in the first line in a diagonal direction of the first radiators R12 and R13.

Also, the second radiators R21 and R22 can be arranged in a diagonal direction, the second radiators R22 and R23 can be arranged sequentially in the first line, and the first radiators R24 and R25 positioned sequentially can be arranged in the second line in a diagonal direction of the second radiators R22 and R23.

This structure of the multi-array antenna may be suitable for outputting a desired beam pattern while minimizing the mutual interference between radiators.

Referring to FIG. 4, the first radiators R11 to R18 and the second radiators R21 to R28 can be arranged alternately in a zigzagging form.

In short, the combination of the first radiators and the second radiators can be changed in various ways as long as the first radiators are arranged separately in the first line and second line, and the second radiators are arranged separately in the first line and second line. Of course, the power distribution to the first radiators and the power distribution to the second radiators may be performed separately.

Figure 5:
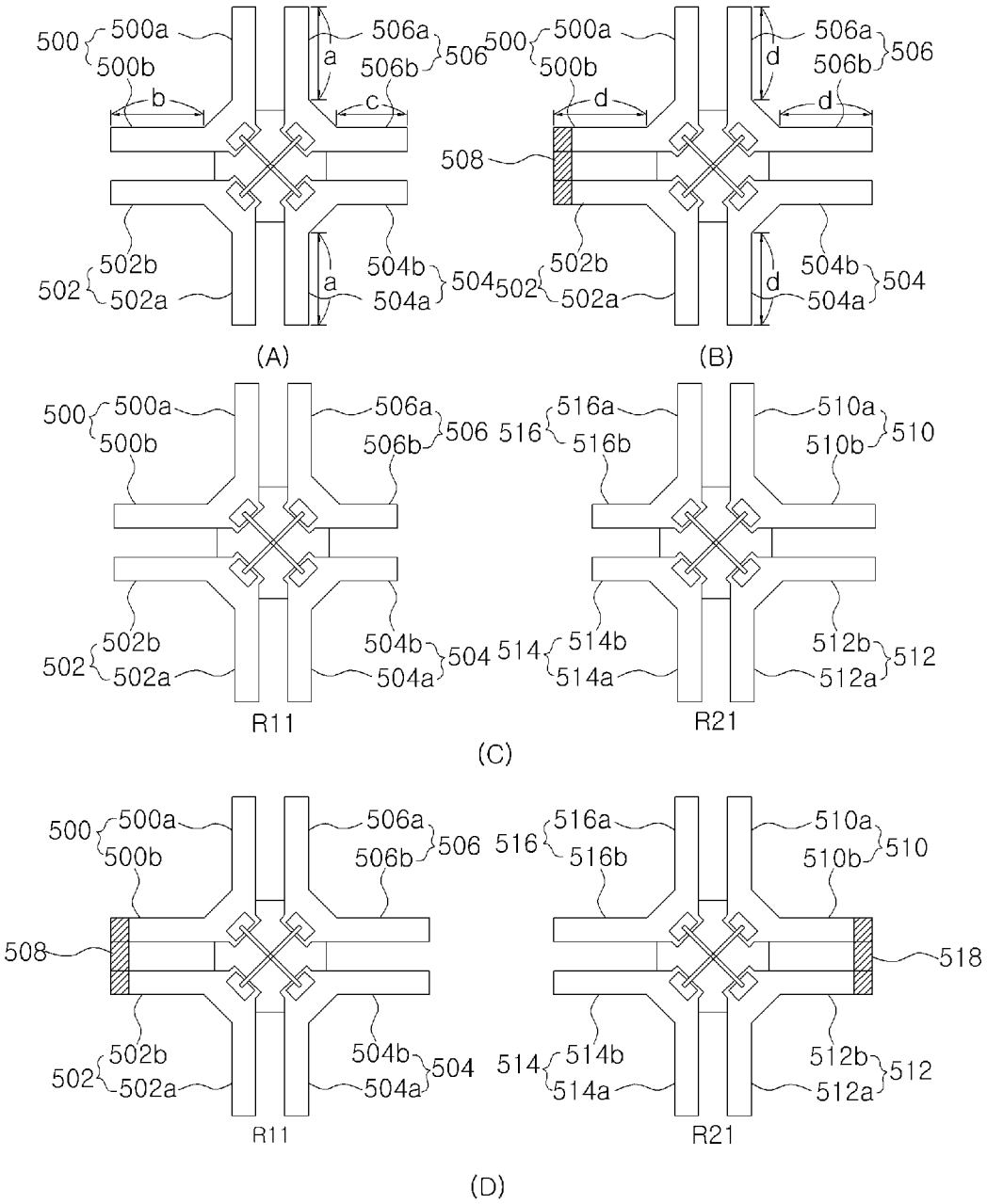
FIG. 5 is a diagram schematically illustrating radiators according to an embodiment of the invention.

FIG. 5 is a diagram schematically illustrating radiators according to an embodiment of the invention.

In describing an embodiment of the invention, it will be assumed that a first radiator and a second radiator have the same structure, and the first radiators and second radiators will be referred to collectively as radiators.

Referring to FIG. 5(A), a radiator according to this embodiment may include a feeding part, a multiple number of radiating members 500, 502, 504, and 506, and a balun part. The descriptions of the feeding part and the balun part will be provided later on, and a description of the radiating members 500, 502, 504, and 506 is provided first.

The vertical portion 500*a* of the first radiating member 500, the vertical portion 506*a* of the fourth radiating member 506, the vertical portion 502*a* of the second radiating member 502, and the vertical portion 504*a* of the third radiating member 504 may all have the same length of "a", as illustrated in FIG. 5(A).

The horizontal portion 500*b* of the first radiating member 500 and the horizontal portion 502*b* of the second radiating member 502 can have a length of "b", whereas the horizontal portion 504*b* of the third radiating member 504 and the horizontal portion 506*b* of the fourth radiating member 506 can have a different length of "c".

According to an embodiment of the invention, the horizontal portion 504*b* of the third radiating member 504 and the horizontal portion 506*b* of the fourth radiating member 506 can have a smaller electrical length than that of the horizontal portion 500*b* of the first radiating member 500 and the horizontal portion 502*b* of the second radiating member 502. For example, the horizontal portion 504*b* of the third radiating member 504 and the horizontal portion 506*b* of the fourth radiating member 506 can physically have a smaller length than the horizontal portion 500*b* of the first radiating member 500 and the horizontal portion 502*b* of the second radiating member 502. Here, "a" and "b" can be of the same value.

According to another embodiment of the invention, the end portions of all of the radiating members 500, 502, 504, and 506 can each be bent. As a result, the size of the multi-array antenna can be reduced.

In short, the horizontal portion 504*b* of the third radiating member 504 and the horizontal portion 506*b* of the fourth radiating member 506 can have a smaller electrical length compared to the horizontal portion 500*b* of the first radiating member 500 and the horizontal portion 502*b* of the second radiating member 502.

An array of radiators having such structures is described below with reference to FIG. 5(C). For the sake of convenience, it will be assumed that the first radiator is R11 and that the second radiator is R21. Also, it will be assumed that the first radiator R11 includes a first radiating member 500, second radiating member 502, third radiating member 504, and fourth radiating member 506, and that the second radiator R21 includes a fifth radiating member 510, sixth radiating member 512, seventh radiating member 514, and eighth radiating member 516.

According to an embodiment of the invention, the radiators R11 and R21 can be arranged such that the horizontal portion 504*b* on the third radiating member 504 and the horizontal portion 506*b* on the fourth radiating member 506 of the first radiator R11 face the horizontal portion 514*b* on the seventh radiating member 514 and the horizontal portion 516*b* on the eighth radiating member 516. Here, the horizontal portion 504*b* on the third radiating member 504 and the horizontal portion 506*b* on the fourth radiating member 506 of the first radiator R11 can have a smaller electrical length compared to that of the horizontal portion 500*b* on the first radiating member 500 and the horizontal portion 502*b* on the second radiating member 502, and the horizontal portion 514*b* on the seventh radiating member 514 and the horizontal portion 516*b* on the eighth radiating member 516 of the second radiator R21 can have a smaller electrical length compared to that of the horizontal portion 510*b* on the fifth radiating member 510 and the horizontal portion 512*b* on the sixth radiating member 512. As a result, the first radiation pattern 200 outputted from the first radiator R11 may face an outward direction from the reflector plate 100, and the second radiation pattern 202 outputted from the second radiator R21 may also face an outward direction from the reflector plate 100. Consequently, the mutual coupling between the first radiator R11 and the second radiator R21 can be minimized, and as such, the distance between the first radiator R11 and the second radiator R21 can be kept at 0.4λ or smaller.

Although the descriptions above use an example of the first radiator R11 and the second radiator R21 facing each other, all of the other first radiators and other second radiators that face each other may also be arranged in the same structure.

Looking at the structure of a radiator again with reference to FIG. 5(B), the radiating members 500, 502, 504, and 506 can all have the same physical length. However, a dielectric member 508 can be joined to the horizontal portion 500*b* on the first radiating member 500 and the horizontal portion 502*b* on the second radiating member 502. Of course, it is possible to have one dielectric member 508 joined to both the horizontal portion 500*b* on the first radiating member 500 and the horizontal portion 502*b* on the second radiating member 502, and is also possible to have two dielectric members joined respectively to the horizontal portion 500*b* on the first radiating member 500 and the horizontal portion 502*b* on the second radiating member 502. As a result, the electrical lengths of the horizontal portion 500*b* on the first radiating member 500 and the horizontal portion 502*b* on the second radiating member 502 can be increased. Thus, even though the horizontal portion 500*b* on the first radiating member 500 and the horizontal portion 502*b* on the second radiating member 502 have the same physical lengths as the horizontal portion 504*b* on the third radiating member 504 and the horizontal portion 506*b* on the fourth radiating member 506, the horizontal portion 500*b* on the first radiating member 500 and the horizontal portion 502*b* on the second radiating member 502 can have a greater electrical length compared to that of the horizontal portion 504*b* on the third radiating member 504 and the horizontal portion 506*b* on the fourth radiating member 506.

Considering this from the perspective of a first radiator (e.g. R11) and a second radiator (e.g. R21) that face each other, with reference to FIG. 5(D), a first dielectric member 508 may be joined to the horizontal portion 500*b* on the first radiating member 500 and the horizontal portion 502*b* on the second radiating member 502 of the first radiator R11, while a second dielectric member 518 may be joined to the horizontal portion 510*b* on the fifth radiating member 510 and the horizontal portion 512*b* on the sixth radiating member 512 of the second radiator R21. As a result, even though the horizontal portion 500*b* on the first radiating member 500 and the horizontal portion 502*b* on the second radiating member 502 have the same physical lengths as the horizontal portion 504*b* on the third radiating member 504 and the horizontal portion 506*b* on the fourth radiating member 506, the horizontal portion 500*b* on the first radiating member 500 and the horizontal portion 502*b* on the second radiating member 502 can have a greater electrical length compared to that of the horizontal portion 504*b* on the third radiating member 504 and the horizontal portion 506*b* on the fourth radiating member 506. Also, even though the horizontal portion 510*b* on the fifth radiating member 510 and the horizontal portion 512*b* on the sixth radiating member 512 have the same physical lengths as the horizontal portion 514*b* on the seventh radiating member 514 and the horizontal portion 516*b* on the eighth radiating member 516, the horizontal portion 510*b* on the fifth radiating member 510 and the horizontal portion 512*b* on the sixth radiating member 512 can have a greater electrical length compared to that of the horizontal portion 514*b* on the seventh radiating member 514 and the horizontal portion 516*b* on the eighth radiating member 516.

In short, in a multi-array antenna according to an embodiment of the invention, the radiating member portions of a first radiator and the radiating member portions of a second radiator that face each other can have smaller electrical lengths than other radiating member portions. Consequently, the first radiators and second radiators can output radiation patterns as illustrated in FIG. 2.

Although the descriptions above refer to each radiator having four radiating members in order to generate multiple polarization, each of the radiators can include two radiating members in cases of generating single polarization. Of course, in these cases also, the radiating member portions of the first radiator and the radiating member portions of the second radiator that face each other can be implemented with smaller electrical lengths compared to other radiating member portions.

Below, a description is provided of the power feed to the first radiator and second radiator in a multi-array antenna according to an embodiment of the invention.

Figure 6:
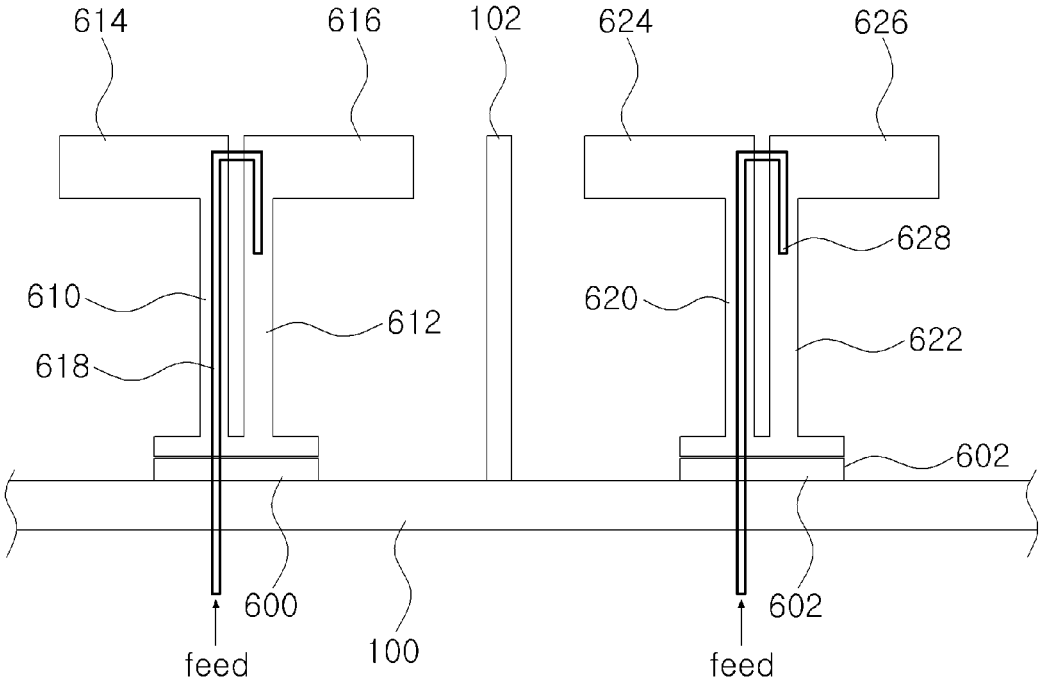
FIG. 6 is a diagram illustrating the feeding structure for radiators according to an embodiment of the invention.
Figure 6:
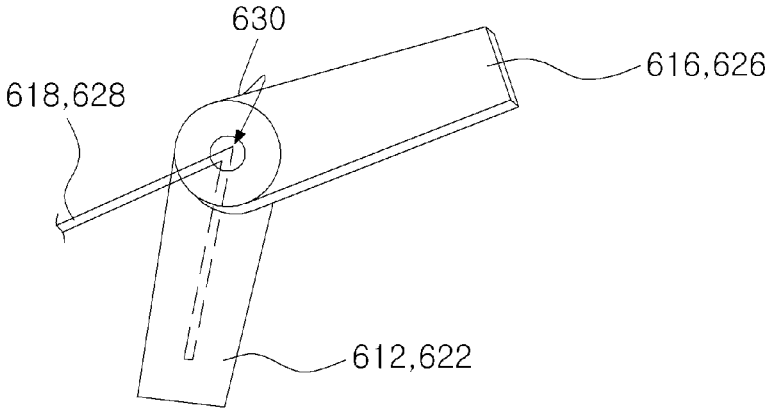

FIG. 6 is a diagram illustrating the feeding structure for radiators according to an embodiment of the invention.

Referring to FIG. 6(A), the multi-array antenna of this embodiment may include a reflector plate 100, a first radiator and a second radiator facing each other, a first insulation part 600, a second insulation part 602, and a choke member 102.

The first radiator may be arranged over the first insulation part 600 and may include a feeding part 610, a balun part 612, a multiple number of radiating members 614 and 616, and a first feed line 618.

The feeding part 610 may be a path for power feed, and although it is not clearly shown in FIG. 6, a first space may be formed in the feeding part 610 along its lengthwise direction, i.e. in a direction orthogonal to the reflector plate 100.

The balun part 612 may have a second space 630 formed therein, as illustrated in FIG. 6(B).

The first feed line 618 may pass through the reflector plate 100 and the insulation part 600 into the first space of the feeding part 610 and the second space 630 of the balun part 612. That is, the first feed line 618 may pass through the first space and extend into the second space 630. According to an embodiment of the invention, the first feed line 618 may not physically contact the balun part 612, as illustrated in FIG. 6(B), i.e. may be capacitively coupled with the balun part 612.

The second radiator may be arranged symmetrically to the first radiator with respect to the choke member 102 and may be arranged over the second insulation part 602. This second radiator may include a feeding part 620, a balun part 622, radiating members 624 and 626, and a second feed line 628.

However, the structure and arrangement of the second radiator may the same as those of the first radiator, and as such, their description is omitted here.

The insulation parts 600 and 602 may be insulators and may support the first radiator and the second radiator, respectively.

The choke member 102 may be arranged between the first radiator and the second radiator. Here, the choke member 102 can be connected directly onto the reflector plate 100 as illustrated in FIG. 6(A) or can be separated from the reflector plate 100. In cases where the choke member 102 is separated from the reflector plate 100, the choke member 102 can be supported by a plastic support part.

According to an embodiment of the invention, a choke member 102 or 104 can have partially varying heights.

In short, the feed lines 618 and 628 may be capacitively coupled with the balun part 612 of the first radiator and the balun part 622 of the second radiator, respectively.

Although it was not described above, there can be power distributors included on the rear surface of the reflector plate 100 for supplying power to the feed lines 618 and 628, respectively. In practice, a first power distributor may distribute power to the first radiators, and a second power distributor may distribute power to the second radiators.

According to an embodiment of the invention, the first feed line 618 may be electrically connected to a distributing line of the first power distributor, and as a result, the power inputted from the outside may be transferred to the first radiator. That is, the first feed line 618, while keeping electrically connected to the first power distributor, may pass through the reflector plate 100 and the insulation part 600 and then be inserted into the first space of the feeding part 610 and the second space 630 of the balun part 612. Of course, the second radiator may also be implemented in the same structure as for the first radiator.

A conventional antenna is structured such that the radiator penetrates the reflector plate to be electrically connected to a power distributor on the rear surface of the reflector plate. That is, unlike an antenna based on an embodiment of the invention, in which the reflector is positioned only on the upper surface of the reflector plate 100, a conventional antenna is implemented with the radiator itself arranged penetrating the reflector plate, i.e. with the radiator present on both the rear surface and the upper surface of the reflector plate.

The differences in properties resulting from this structural difference between an antenna based on an embodiment of the invention and a conventional antenna are as follows.

First, whereas the conventional antenna may have the radiator arranged penetrating through from the upper surface of the reflector plate to the rear surface, an antenna based on an embodiment of the invention may have the radiator positioned only on the upper surface of the reflector plate 100 without penetrating the reflector plate 100. As larger holes in the reflector plate may degrade the properties of an antenna, the antenna based on an embodiment of the invention can provide more superior antenna properties compared to the conventional antenna.

Second, the conventional antenna may have the feed line connected directly (soldered) to the balun part of the radiator. In this case, it may be necessary to plate the radiator with a plating material, such as a compound material of copper and tin, for example, in order to solder the feed line to the feeding part. As a result, a plating process may be additionally needed, so that the cost of manufacturing the antenna may be increased. With the antenna based on an embodiment of the invention, however, the feed line 618 or 628 may implement capacitive coupling with the balun part 612 or 622 instead of being connected directly to the balun part 612 or 622. That is, the feed line 618 or 628 may not be connected by soldering to the balun part 612 or 622, so that there may be no need to apply plating on the radiator. Thus, the process for manufacturing the antenna can be simplified, and the manufacturing cost can be reduced.

Third, in the structure of the conventional antenna, the reflector itself may penetrate through the reflector plate and then be connected to the power distributor, so that there may be many portions where soldering is necessary. However, in an antenna based on an embodiment of the invention, the reflector itself may be arranged only on an upper surface of the reflector plate 100 with only the feed line 618 or 628 connected to the power distributor, so that the number of portions where soldering is to be performed can be reduced considerably. In practice, in connecting a radiator to a power distributor, it can be seen that the antenna based on an embodiment of the invention has the soldering portions reduced by about 67% compared to the conventional antenna. Therefore, the costs associated with the soldering can be reduced, and the processing times needed for performing the soldering can be shortened.

In short, an antenna based on an embodiment of the invention can reduce the manufacturing process steps and time and can reduce manufacturing costs compared to the conventional antenna. Consequently, the antenna based on an embodiment of the invention can implement superior electrical properties at lower costs.

Figure 7:
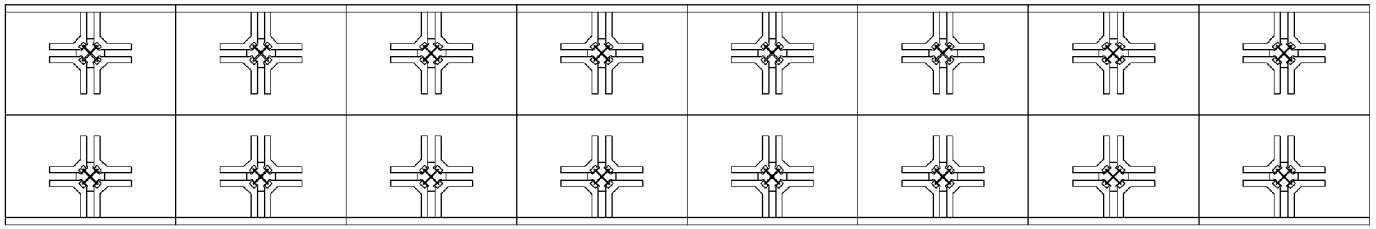
FIG. 7 is a diagram illustrating a multi-array antenna according to an embodiment of the invention.
Figure 8:
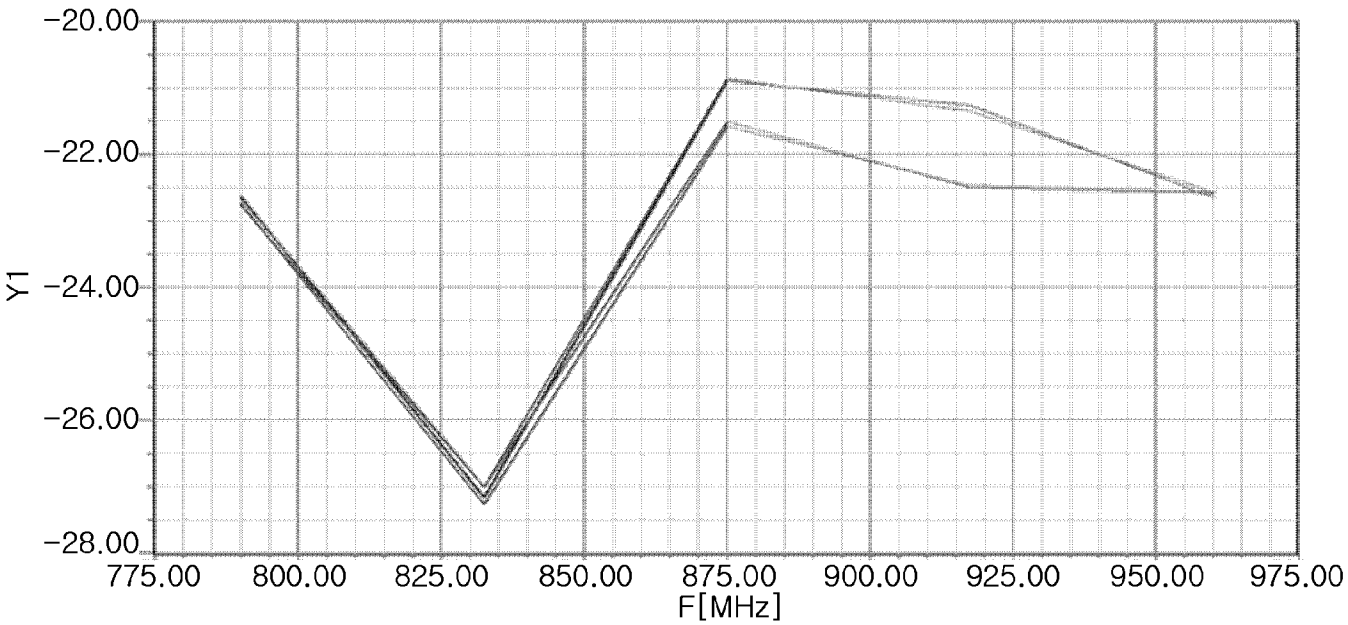
FIG. 8, FIG. 9, and FIG. 10 are diagrams illustrating the electrical properties of the multi-array antenna of FIG. 7.
Figure 9:
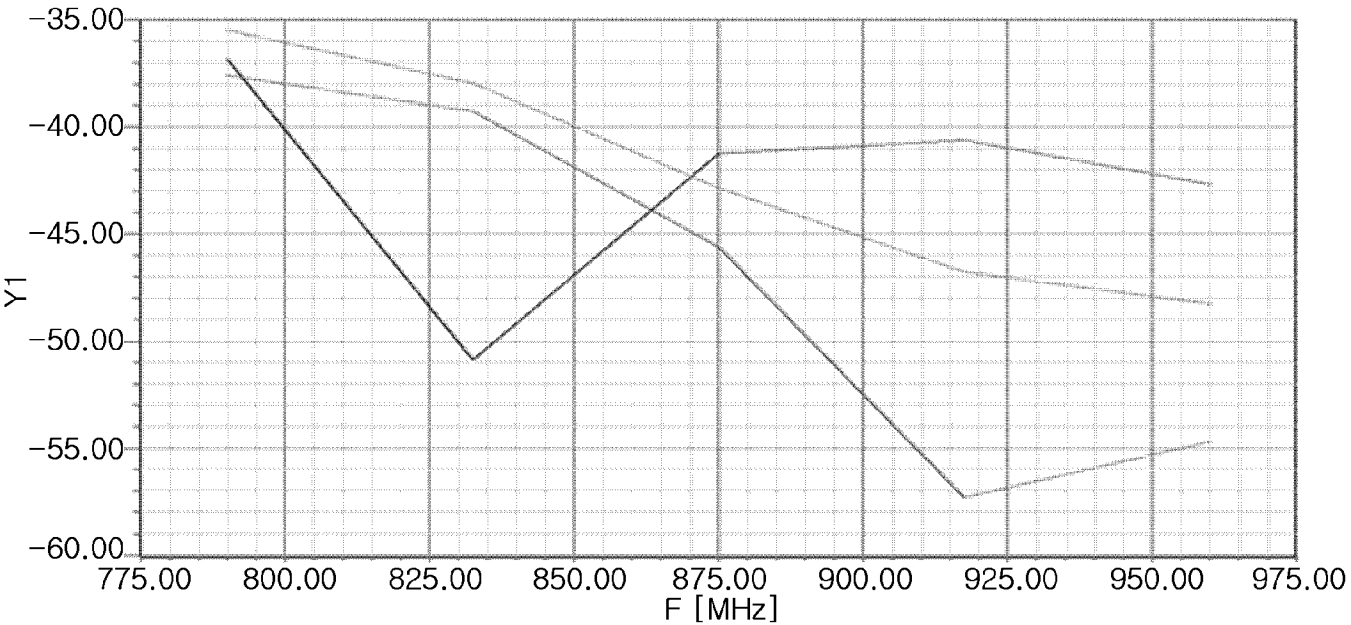
Figure 10:
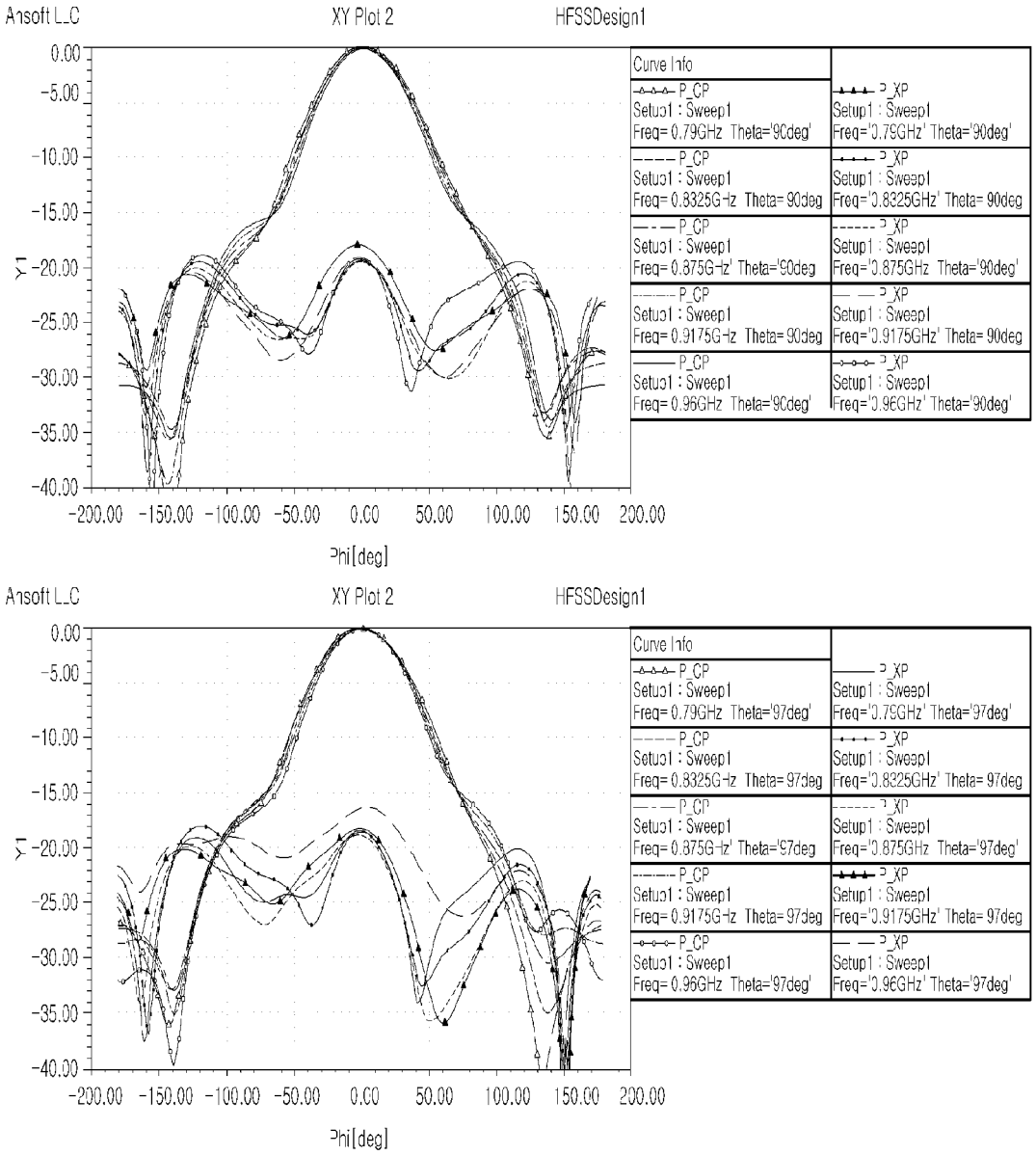

FIG. 7 is a diagram illustrating a multi-array antenna according to an embodiment of the invention, while FIG. 8 through FIG. 10 are diagrams illustrating the electrical properties of the multi-array antenna of FIG. 7.

The electrical properties were tested after arranging eight first radiators and eight second radiators as illustrated in FIG. 7. Here, the radiators were arranged as in FIG. 3.

Referring to FIG. 8, it can be seen that the reflection loss of a multi-array antenna according to an embodiment of the invention is 21 dB or higher in the 790 MHz to 960 MHz band. That is, the multi-array antenna has superior reflection loss properties.

Referring to FIG. 9, it can be seen that the isolation of the multi-array antenna implemented with a tilt angle of −4 T is 35 dB or higher in the 790 MHz to 960 MHz band. That is, the multi-array antenna also has superior isolation properties. In conclusion, the multi-array antenna based on an embodiment of the invention can have superior isolation properties while being implemented with low cost and a small size.

Referring to FIG. 10, it can be seen that the horizontal beam pointing error of the multi-array antenna based on an embodiment of the invention is smaller than ±2.5 degrees, and the horizontal beam tracking error is smaller than 1.5 dB. That is, the multi-array antenna has superior beam pointing error and tracking error.

In summary, the multi-array antenna based on an embodiment of the invention is superior in terms of electrical properties such as reflection loss, isolation properties, beam pointing error and tracking error, etc., and still can be implemented with low cost and a small size.

The embodiments of the invention described above are disclosed for illustrative purposes. Those of ordinary skill in the field of art to which the present invention pertains would understand that various modifications, alterations, and additions can be made without departing from the spirit and scope of the invention, and that such modifications, alterations, and additions are encompassed by the scope of claims below.

What is claimed is:

1. A multi-array antenna comprising:

a reflector plate;

first radiators arranged over a surface of the reflector plate and configured to form a first beam; and second radiators arranged over a surface of the reflector plate and configured to form a second beam that is different from the first beam, wherein one of the first radiators and one of the second radiators are arranged in an imaginary first line along a lengthwise direction of the reflector plate, another one of the first radiators and another one of the second radiators are arranged in an imaginary second line, the first radiator arranged in the first line and the first radiator arranged in the second line are positioned in a diagonal direction, and the second radiator arranged in the first line and the second radiator arranged in the second line are positioned in a diagonal direction, the one of the first radiators and the other one of the second radiators are arranged side by side along a lateral direction of the reflector plate and face each other, and the other one of the first radiators and the one of the second radiators are arranged side by side along the lateral direction of the reflector plate and face each other.

2. The multi-array antenna of claim 1, wherein the first radiator arranged in the first line outputs a first radiation pattern in a direction opposite to the second line with respect to the first line, the first radiator arranged in the second line outputs a second radiation pattern in a direction opposite to the first line with respect to the second line, the second radiator arranged in the first line outputs a third radiation pattern in a direction opposite to the second line with respect to the first line, and the second radiator arranged in the second line outputs a fourth pattern in a direction opposite to the first line with respect to the second line.

3. The multi-array antenna of claim 1, wherein the first line includes a first radiator, a second radiator, a second radiator, and a first radiator arranged sequentially, and the second line includes a second radiator, a first radiator, a first radiator, and a second radiator arranged sequentially.

4. The multi-array antenna of claim 1, wherein if a first radiator is arranged in the first line, the second line includes a second radiator arranged therein facing the first radiator, and the first radiator and the second radiator have a same structure.

5. The multi-array antenna of claim 1, wherein a first radiator and a second radiator facing each other each includes a plurality of radiating members, a portion of the radiating members of the first radiator facing the second radiator has a smaller electrical length than does other portions of the radiating members, and a portion of the radiating members of the second radiator facing the first radiator has a smaller electrical length than does other portions of the radiating members of the second radiator.

6. The multi-array antenna of claim 5, wherein all of the radiating members are bent.

7. The multi-array antenna of claim 1, wherein a first radiator and a second radiator facing each other each includes a plurality of radiating members, the radiating members of the first radiator all have a same physical length but a portion of the radiating members facing the second radiator has a first dielectric member joined thereto, and the radiating members of the second radiator all have a same physical length but a portion of the radiating members facing the first radiator has a second dielectric member joined thereto.

8. The multi-array antenna of claim 1, wherein the multi-array antenna further comprises an insulation part arranged over the reflector plate, the first radiator is positioned over the insulation part and comprises a feeding part, a first radiating member connected with the feeding part, a balun part, and a second radiating member connected with the balun part, and wherein the feeding part has a first space formed therein, the balun part has a second space formed therein, a feed line passes through the first space and extends to the second space of the balun part, and the feed line capacitively couples with the balun part.

9. The multi-array antenna of claim 1, wherein choke members are arranged respectively between all of the radiators.

* * * * *